US008490535B1

(12) United States Patent
Moore et al.

(10) Patent No.: US 8,490,535 B1
(45) Date of Patent: Jul. 23, 2013

(54) FLASH AND SOUND SUPPRESSOR FOR A FIREARM

(75) Inventors: Charles Moore, Columbia, SC (US); Thomas Mooty, Columbia, SC (US)

(73) Assignee: FN Manufacturing, LLC, Columbia, SC (US)

( * ) Notice: Subject to any disclaimer, the term of this patent is extended or adjusted under 35 U.S.C. 154(b) by 235 days.

(21) Appl. No.: 13/213,190

(22) Filed: Aug. 19, 2011

Related U.S. Application Data

(60) Provisional application No. 61/375,530, filed on Aug. 20, 2010.

(51) Int. Cl.
*F41A 21/00* (2006.01)

(52) U.S. Cl.
USPC ..... 89/14.2; 89/14.3; 89/14.4; 181/223; 42/1.06

(58) Field of Classification Search
USPC ..... 89/14.4, 14.3, 14.2; 181/223; 42/1.06, 42/79
See application file for complete search history.

(56) References Cited

U.S. PATENT DOCUMENTS

| | | | | |
|---|---|---|---|---|
| 3,710,679 | A * | 1/1973 | Werbell, III | 89/14.4 |
| 5,361,677 | A * | 11/1994 | Warner et al. | 89/14.2 |
| 6,308,609 | B1 | 10/2001 | Davies | |
| 7,073,426 | B1 | 7/2006 | White | |
| 7,237,467 | B1 | 7/2007 | Melton | |
| 7,308,967 | B1 | 12/2007 | Hoel | |
| 7,516,690 | B2 * | 4/2009 | McClellan | 89/14.4 |
| 7,587,969 | B2 * | 9/2009 | Silvers | 89/14.4 |
| 7,594,464 | B2 * | 9/2009 | Dueck | 89/14.4 |
| 7,832,323 | B1 * | 11/2010 | Davies | 89/14.4 |
| 7,874,238 | B2 * | 1/2011 | Silvers | 89/14.4 |
| 8,096,222 | B2 * | 1/2012 | Silvers | 89/14.4 |
| 1,017,003 | A1 | 2/2012 | Kenney | |
| 2007/0266844 | A1 * | 11/2007 | Dueck | 89/14.4 |
| 2008/0148928 | A1 * | 6/2008 | McClellan | 89/14.4 |
| 2012/0272818 | A1 * | 11/2012 | Dueck et al. | 89/14.4 |

FOREIGN PATENT DOCUMENTS

| | | |
|---|---|---|
| FR | 981869 | 1/1951 |

* cited by examiner

*Primary Examiner* — Michael David
(74) *Attorney, Agent, or Firm* — Michael A. Mann; Nexsen Pruet, LLC

(57) ABSTRACT

A flash hider, a sound suppressor and a quick-disconnect coupler that holds the sound suppressor to a flash hider is disclosed. The quick-disconnect coupler enables the suppressor to be attached to the flash hider so that the hider forms a nozzle at the entrance to the sound suppressor to facilitate the operation of the suppressor. The coupler includes a collar that threads to the first part of the suppressor over plural holes formed therein. Camming latches set in these holes are held firmly against flat surfaces on the exterior of the flash hider by the collar. A spring lock holds the collar against rotation until it is released.

14 Claims, 3 Drawing Sheets

FLASH AND SOUND SUPPRESSOR FOR A FIREARM

PRIORITY CLAIM

Priority is claimed to U.S. provisional patent application Ser. No. 61/375,530, filed Aug. 20, 2010; to U.S. non-provisional patent application Ser. No. 13/032,804 filed Feb. 23, 2011, which in turn claims priority to U.S. provisional patent application Ser. No. 61/309,047 filed Mar. 1, 2010; to U.S. provisional patent application Ser. No. 61/375,339, filed Aug. 20, 2010; and to U.S. provisional patent application 61/375,620, filed Aug. 20, 2010, all of which are incorporated by reference herein in their entirety.

BACKGROUND OF THE INVENTION

A military firearm may have a flash hider threaded to the end of its barrel. The flash hider is intended to reduce both the primary flash caused by the initial explosion of the powder charge when a round of ammunition is fired, and the secondary flash caused when the partially combusted gases and hot air from the barrel reignite following the shock of meeting the colder air surrounding the end of the barrel. The visible flash is an indication of the marksman's location. Hiding the flash makes it difficult to locate that marksman.

A sound suppressor reduces the sound of a firearm being fired for the same objective for which a flash hider reduces flash, namely, to make it more difficult to detect the location of the marksman. A sound suppressor is inherently a flash hider because it is typically a closed cylinder and thus prevents the flash from being seen while it performs its primary function of suppressing sound.

Both a flash hider and a sound suppressor are typically fitted to the threaded end of the barrel of a firearm.

SUMMARY OF THE INVENTION

The present invention is a combination of a flash hider, a sound suppressor and a coupler that holds the sound suppressor to a flash hider. The flash hider does not need to be removed to use the sound suppressor or replaced after the sound suppressor is removed. Furthermore, the coupler enables the suppressor to be attached to the flash hider rather than to the barrel proximate to the flash hider so that the flash hider forms a nozzle at the entrance to the sound suppressor and thereby facilitates the operation of the suppressor. The present coupler also enables the sound suppressor to be removed and installed quickly and securely.

A feature of the present flash hider is that it is characterized by three tines that are slightly tapered, that are long, and that contain stepped features on their sides that face the gaps between the tines. These stepped features expand the distance between the tines for hot gases traveling radially from the central bore of the flash hider and allow those gases to cool quickly. The steps also create turbulent mixing with the cooler air outside the flash hider to reduce the shock of the hot gases hiting the cooler air and to reduce the temperature differential between the two to avoid reignition and the attendant secondary flash.

A feature of the present sound suppressor is that its internal baffle structure moves a portion of the axial flow of high energy gases radially and into a path where those gases cross and re-cross the centerline of the suppressor to turbulently mix with the axial flow and more quickly give up heat to the baffles and to the suppressor housing itself for more effective sound suppression.

A feature of the coupler is that it can be quickly unlocked and rotated clockwise to secure a flash suppressor to a flash hider, or unlocked and rotated counter-clockwise to allow the suppressor to be removed. A spring lock automatically locks the coupler and is unlocked simply by pressing the spring lock handle.

These and other features and their advantages will be apparent to those of ordinary skill in the art from a careful reading the Detail Description of Embodiments accompanied by the following Drawings.

BRIEF DESCRIPTION OF THE DRAWINGS

In the figures.

DETAILED DESCRIPTION OF PREFERRED EMBODIMENTS

Figure 1:
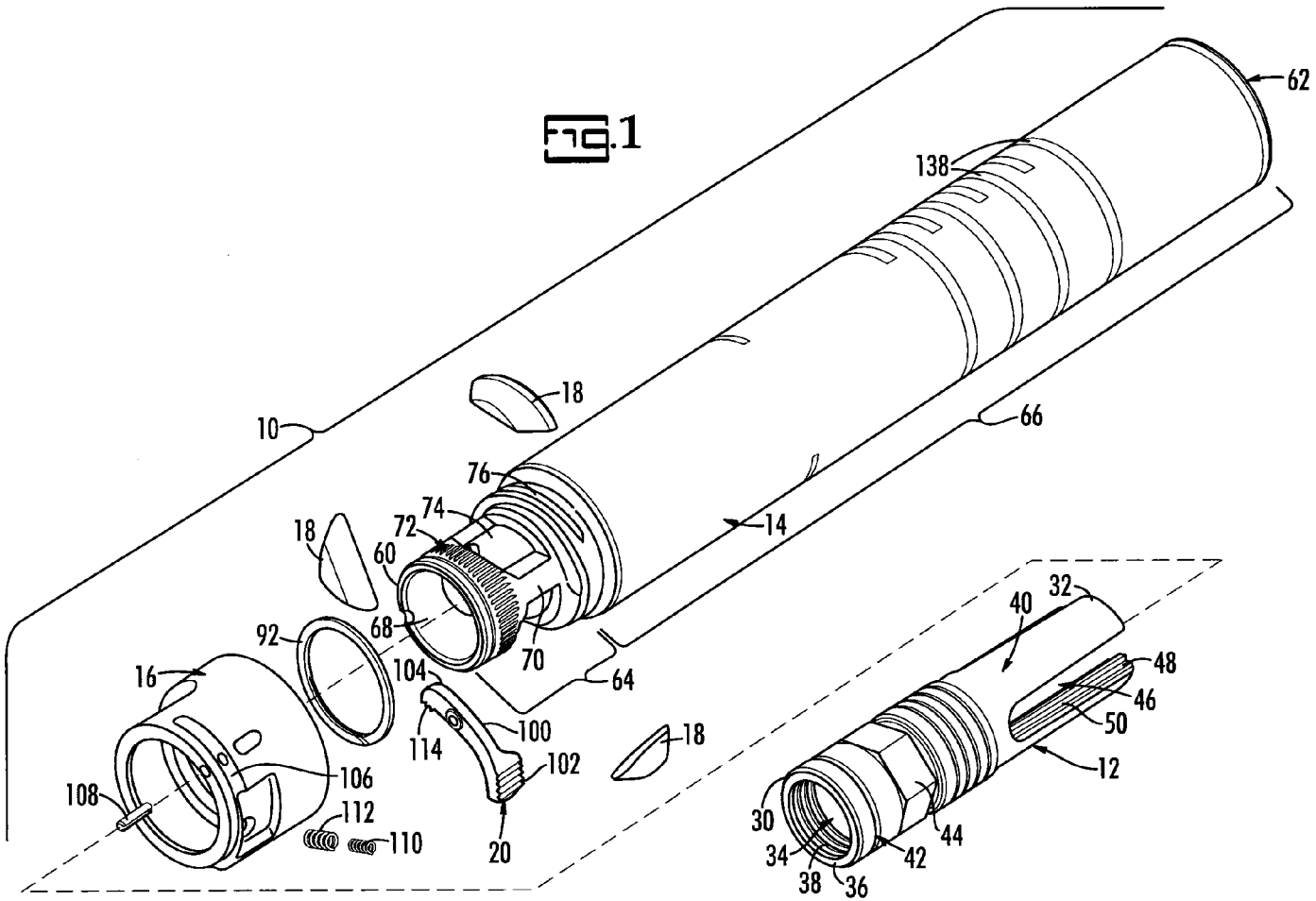
FIG. 1 is an exploded view of a coupler for attaching a sound suppressor to a flash hider of a firearm, according to an embodiment of the present invention.

The present device is a quickly-disconnectable sound suppressor for a firearm. The device is also a quick-disconnect flash and sound suppressor for a firearm with a flash hider on the end of its barrel. Finally, the present device is a coupler for attaching a sound suppressor to a flash hider.

Referring now to FIGS. 1-4, FIG. 1 illustrates the components of the present flash and sound suppressor, generally indicated by reference number 10, in an exploded view. In this view, a flash hider 12 and a sound suppressor 14 are coupled by a collar 16 using plural camming latches 18 and a spring lock 20.

Flash hider 12 has a first or proximal end 30 and an opposing second or distal end 32. Flash hider 12 is essentially a tube with a central bore 34 that defines a wall 36. First end 30 has interior threads 38 that allow flash hider 12 to be threaded to the barrel of a firearm (not shown). Flash hider 12 has an exterior surface 40 that carries an annular recess 42 and, distal to recess 42, several flat surfaces 44. Toward its second end 32, wall 36 of flash hider 12 has gaps 46 which define three tines 48.

Tines 48 are long and tapered toward second end 32 and carry at least one step 50 on each side that faces gap 46. A step 50 is a pair of angled changes in the surface of tines 48 that widen the distance from one tine 48 to the next as measured azimuthally, so that, when hot combustion gases from central bore 34 flow radially between tines 48 and through gaps 46, they expand to cool. The side of a tine 48 is initially more or less radially directed. At a step 50, that generally radial direction abruptly angles azimuthally away from the adjacent tine 48 and then returns abruptly to a generally radial direction much like a step in a stairway.

Suppressor 14 is a closed tube with a first or proximal end 60 and an opposing, second or distal end 62. Suppressor 14 may be further defined by a first portion 64 and a second portion 66. First portion is configured to receive flash hider 12 and to be coupled to flash hider 12 by collar 16, as will be explained below.

First portion 64 has an opening 68 dimensioned to receive second end 32 of flash hider 12. First portion 64 of flash hider 64 has an exterior surface 70 with a gear surface 72 at first end 60 followed by a series of annular holes 74 which are followed in turn by exterior threads 76. These three features: gear surface 72, holes 74 and exterior threads enable suppressor to be coupled to flash hider.

Figure 2:
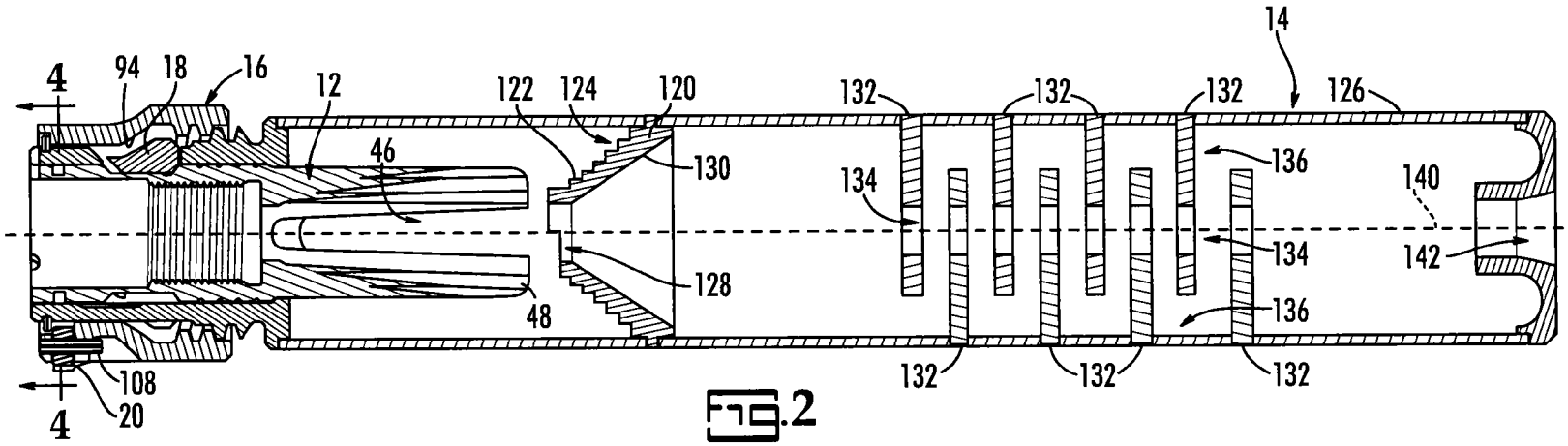
FIG. 2 is a cross-sectional side view of a coupler shown locking a sound suppressor to a flash hider, according to an embodiment of the present invention.
Figure 3:
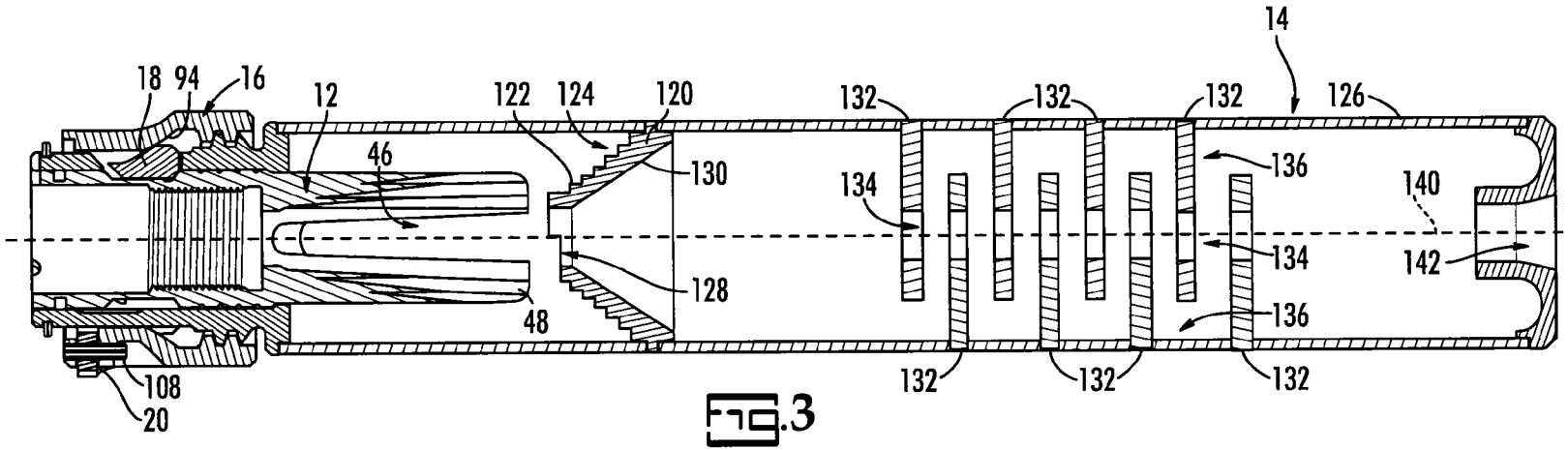
FIG. 3 is a cross-sectional side view of the coupler of FIG. 2 shown with the suppressor unlocked from the flash hider, according to an embodiment of the present invention.

To couple, which means in this case to keep flash hider 12 and suppressor 14 locked together, the three camming latches 18 are first placed in annular holes 74 of suppressor. Then collar 16, which has interior threads 90, is slipped over first portion 64 of suppressor, as best seen in FIGS. 2 and 3. A spring ring 92 is then inserted in to annular recess 42 of flash hider 12 to limit movement of collar 16 in the proximal direction. Camming latches 18 are held by the interior surface 94 of collar 16 in place in holes 74 while holes 74 prevent their axial movement. When collar 16 is rotated clockwise, it advances distally toward sound suppressor 14. As it advances, its interior surface 94 cams camming latches 18 against flat surfaces 44 on the exterior surface 40 of flash hider 12. When collar 16 is rotated counter-clockwise, camming latches 18 are able to move radially outward while otherwise being retained within the space 96 between the interior surface 94 of collar 16 and flat surfaces 44 of flash hider 12 so flash hider 12 may be removed from coupler.

Figure 4:
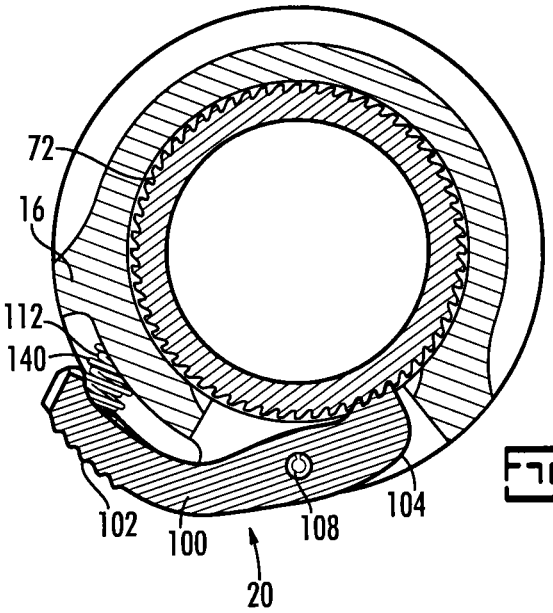
FIG. 4 is a cross sectional view taken along lines 4-4 of FIG. 2.

To prevent unintentional movement of collar 16, spring lock 20 prevents its rotation. Spring lock 20, as best seen in FIG. 4, has a pawl 100 with a first end 102 and an opposing second end 104 attached to collar 16 within a slot 106 by a pivot pin 108. Two compression springs 110 and 112 urge first end 102 of pawl 100 to pivot away from collar 16 and a tooth 114 on second end 104 to pivot into engagement with gear surface 72 on first portion 64 of sound suppressor 14. By pressing on first end 102 of pawl 100, second end 104 is pivotally raised, and tooth 114 is lifted clear of gear surface 72. Collar 16 is then free to be rotated clockwise or counter-clockwise to lock or unlock flash hider 12 from suppressor 14 or to simply rotate flash hider 12 with respect to suppressor 14.

The attachment of a suppressor 14 to a firearm will inevitably affect the ballistic performance of the firearm. There are potentially six orientations of suppressor with respect to flash hider 12 if flat surfaces 44 are six in number such as would be the case if flash hider 12 had a hexagonal cross-section at the point between its first end 30 and its second end 32. One of those six orientations will likely have the least impact on the ballistics and perhaps an impact that is so negligible that the firearm does not have to be re-zeroed. If so, that orientation can be marked by the user so that whenever the suppressor 14 is coupled to the flash hider 12 on the end of that particular firearm, the same rotational orientation of sound suppressor 14 can be obtained.

Inside second portion 66 of sound suppressor 14, best seen in FIG. 2, tines 48 extend toward second end 62, tapering and with gaps 46 allowing a portion of hot combustion gases to expand radially off center bore, thereby defining a nozzle. Distal to tines 48 is a blast baffle 120 with a front surface 122 that deflects radially flowing gases into a blind corner 124 between the housing 126 of suppressor 14 and blast baffle 120 while allowing other hot combustion gases to flow through a central hole 128 formed in blast baffle 120 for the bullet to pass through.

Blast baffle 120 has a rear surface 130 that acts as a second nozzle in directing a portion of those hot gases passing though central hole 128 radially while a remaining portion continues forward to a first disc baffle of plural disc baffles 132. Each disc baffle 132 is a partial circular disc, with a central hole 134 and a radial opening 136 which may be formed simply by eliminating a section of what would otherwise be a perfectly circular shape. Housing 126 is formed with slots 138 along its length, as best seen in FIG. 1, which can receive disc baffles 132. Disc baffles 132 can be secured in place by welding. Disc baffles 132 are arranged so that radial openings 136 are not aligned axially but are distributed in such a way as to define a path for hot gases to flow from flash hider 12 to second end 62 of suppressor 14 by crossing and recrossing the axis 140 of suppressor 14 until they exit through exit hole 142. In crossing and recrossing axis 140, turbulent mixing and disruption of the gases flowing through central holes 134 of disc baffles 132 by the radial gases accelerates the release of the kinetic energy of the gases to the disc baffles 132 and housing 126. Baffles 132 and housing 136 act thus like a heat exchanger to absorb and radiate the heat from the hot gases passing though suppressor 14 to the surrounding air without flash and with greatly reduced sound.

Those familiar with firearms and their attachments will appreciate that many modifications and substitutions can be made to the foregoing preferred embodiments of the present invention without departing from the spirit and scope of the present invention, defined by the appended claim.

What is claimed is:

1. A flash and sound suppressor for a firearm, said firearm having a barrel with exterior threads at the end thereof, comprising:

(a) a tube with a first end and an opposing second end and having
  (i) a first portion having interior threads in said first end dimensioned to threadably receive said barrel, and
  (ii) a second portion integral to said first portion and with a central bore formed through said first portion and said second portion thereby defining a wall of said tube, said central bore of said tube widening radially and toward said second end of said second portion to form three gaps in said wall thereby define three tines of said wall;

(b) a housing with a central bore coaxial with said central bore of said tube, a first end and an opposing second end, an entrance hole formed in said first end of said housing and dimensioned to receive said second portion of said tube, and an exit hole formed in said second end, said housing having
  (i) a blast baffle for directing a flow of gases and
  (ii) plural baffles spaced apart from said blast baffle, each baffle of said plural baffles being spaced apart from an adjacent baffle of said plural baffles and from said second end to define a flow path through said housing from said first end to said second end, said flow path in part directed radially by said blast baffle and then repeatedly crossing said central bore around said plural baffles; and (c) a collar carried by said first end of said housing, said collar having a locked position and an unlocked position, said collar locking said housing to said tube when in said locked position and allowing said tube to be removed from said housing when in said unlocked position.

2. The flash and sound suppressor as recited in claim 1, wherein said three tines are tapered.

3. The flash and sound suppressor as recited in claim 1, wherein each tine of said three tines has at least one step formed thereon to widen an adjacent gap incrementally in the radial direction from said central bore.

4. The flash and sound suppressor as recited in claim 1, wherein said tines extend into said housing toward said blast baffle.

5. A flash and sound suppressor for a firearm, said firearm having a barrel with exterior threads on the end thereof, said suppressor comprising:

(a) a tube with a central bore there through to define a wall of said tube, said tube having a first end and an opposing second end, with (i) a first portion having interior threads inside said first end dimensioned to threadably receive said barrel therein, and (ii) a second portion integral to said first portion, said central bore of said tube widening radially in said second portion toward said second end forming gaps in said wall, said wall defining tines with said gaps therebetween;

(b) a housing with a central bore coaxial with said central bore of said tube, a first end and an opposing second end, with an entrance formed in said first end of said housing and dimensioned to receive said second portion of said tube, and an exit hole formed in said second end, said housing having a first portion and a second portion, said first portion having an external surface with plural holes formed there through and carrying threads thereon, said second portion of said housing having (i) a blast baffle for directing a flow of gases and (ii) plural baffles spaced apart from said blast baffle, each baffle of said plural baffles being spaced apart from an adjacent baffle of said plural baffles and from said second end to define a flow path through said housing from said first end to said second end, said baffles defining said flow path;

(c) a collar having internal threads and being treaded to said first portion of said housing, said collar having an external surface;

(d) camming latches carried in said holes formed in said first portion of said housing and engaging said external surface of said tube, said collar camming said camming latches against said tube when said collar is threadably rotated with respect to said housing; and (e) a spring lock to prevent rotation of said collar so that said collar holds said camming latches against said tube until said spring lock is released.

6. The flash and sound suppressor as recited in claim 5, wherein said tube has flat areas on said exterior surface and wherein said holes in said first portion of said tube are alignable with said flat areas when said second portion of said tube in inserted into said first portion of said housing, said camming latches engaging said flat areas.

7. The flash and sound suppressor as recited in claim 5, wherein each tine of said tines has at least one step formed thereon to widen an adjacent gap incrementally in the radial direction from said central bore.

8. The flash and sound suppressor as recited in claim 5, wherein said central bore widens at an angle of 45 degrees with respect to a radius from said central bore.

9. The flash and sound suppressor as recited in claim 5, wherein said baffles are formed to be a partial disk with a central hole concentric with said central bore.

10. The flash and sound suppressor as recited in claim 5, wherein said second portion of said housing has plural slots formed there through, each slot of said plural slots dimensioned to receive a baffle of said plural baffles, said each baffle being secured to said housing.

11. A sound suppressor for a firearm with a flash hider, said firearm having a barrel with a flash hider on the end thereof, said flash hider having a central bore, said suppressor comprising:

(a) a housing with a central bore coaxial with said central bore of flash hider, a first end and an opposing second end, with an entrance formed in said first end of said housing that is dimensioned to receive flash hider, and with an exit hole formed in said second end, and wherein said housing has a first portion and an integral second portion, said first portion having an external surface carrying threads, said second portion of said housing having plural baffles therein, each baffle of said plural baffles being spaced apart from an adjacent baffle of said plural baffles which, together with said second portion of said tube defines a flow path through said housing, and wherein, when said flash hider is inserted into said entrance of said first portion of said housing and a round of ammunition is fired from said firearm, hot gases from firing said round of ammunition expand radially from said flash hider into said second portion through said gaps and toward said plural baffles; and (c) a collar having internal threads and being treaded to said first portion of said housing, said collar having an external surface, said collar having a locked position and an unlocked position, wherein said collar locks said housing to said flash hider when in said locked position and allows said flash hider to be removed from said housing when in said unlocked position.

12. The sound suppressor as recited in claim 11, wherein said plural baffles includes a blast baffle positioned between said flash hider and remaining baffles of said plural baffles, said blast baffle holding a portion of said radially expanded hot gases from said flash hider away from said center bore of said housing.

13. The sound suppressor as recited in claim 11, wherein said first portion of said housing has plural holes formed there through and wherein said sound suppressor further comprises camming latches dimensioned to be receivable within said holes in said first portion, and wherein said collar engages a top surface of said camming latches and holds them in engagement with said first portion of said flash hider, when said collar is rotated clockwise with respect to said housing to said locked position, and further comprising a spring lock to hold said collar in said locked position.

14. A flash hider for a firearm, said firearm having a barrel with exterior threads on the end thereof, said flash hider, comprising:

(a) a tube with a central bore there through to define a wall of said tube, said tube having a first end and an opposing second end, with (i) a first portion having interior threads inside said first end dimensioned to threadably receive said barrel therein, and (ii) a second portion integral to said first portion, said central bore of said tube widening radially in said second portion toward said second end forming gaps in said wall, said wall defining tines with said gaps therebetween;

(b) a housing with a central bore coaxial with said central bore of said tube, a first end and an opposing second end, with an entrance formed in said first end of said housing and dimensioned to receive said second portion of said tube, and an exit hole formed in said second end, said housing having a first portion and a second portion, said first portion having an external surface with plural holes formed there through and carrying threads thereon, said second portion of said housing having plural baffles spaced apart from said blast baffle, each baffle of said plural baffles being spaced apart from an adjacent baffle of said plural baffles and from said second end to define a flow path through said housing from said first end to said second end, said baffles defining said flow path; and (c) a collar having internal threads and being treaded to said first portion of said housing, said collar having an external surface, said collar having a locking position wherein said collar is rotated clockwise with respect to said housing and an unlocked position wherein said collar is rotated counter-clockwise with respect to said housing.

* * * * *